US005363081A

United States Patent [19]

Bando et al.

[11] Patent Number: 5,363,081

[45] Date of Patent: Nov. 8, 1994

[54] LINE TRANSFORMER AND MANUFACTURING PROCESS THEREOF

[75] Inventors: Masahiro Bando; Katsuhiro Misaki; Toshimi Kaneko, all of Nagaokakyo, Japan

[73] Assignee: Murata Manufacturing Co., Ltd., Nagaokakyo, Japan

[21] Appl. No.: 87,287

[22] Filed: Jul. 8, 1993

[30] Foreign Application Priority Data

Jul. 9, 1992 [JP] Japan ..... 4-182514

[51] Int. Cl.[5] ..... H01F 27/28; H01F 41/04

[52] U.S. Cl. ..... 336/200; 29/602.1; 336/225

[58] Field of Search ..... 336/200, 232, 225, 220; 29/602.1, 605

[56] References Cited

U.S. PATENT DOCUMENTS 4,313,151 1/1982 Vranken ..... 336/200
4,313,152 1/1982 Vranken ..... 336/200

*Primary Examiner*—Thomas J. Kozma
*Attorney, Agent, or Firm*—Burns, Doane, Swecker & Mathis

[57] ABSTRACT

A laminate type line transformer. On one side of an insulating substrate, a primary coil section which is a laminate of a first coil pattern layer and a second coil pattern layer with an insulating layer in-between is provided. On the other side of the insulating substrate, a secondary coil section which is a laminate of a first coil pattern layer and a second coil pattern layer with an insulating layer in-between is provided. Both in the primary coil section and in the secondary coil section, conductors of the first coil pattern layer and conductors of the second coil pattern layer are electrically connected alternately via a hole made in the insulating layer.

10 Claims, 4 Drawing Sheets

LINE TRANSFORMER AND MANUFACTURING PROCESS THEREOF

BACKGROUND OF THE INVENTION

1. Field of the Invention

The present invention relates to a line transformer to be installed in a modem for modulating and demodulating a signal.

2. Description of Related Art

In a data communication system which uses a telephone and a telephone line, generally, a modem for modulating and demodulating a signal is necessary. In the modem, a line transformer is provided. The line transformer is to protect the line from an anomalous voltage when an accident occurs in the modem or in a terminal. A typical conventional line transformer has a core wound with a primary coil and a secondary coil in an insulating case.

However, the structure of the line transformer has been obstructed down-sizing and thinning of the modem.

SUMMARY OF THE INVENTION

An object of the present invention is to provide a compact and thin line transformer.

In order to attain the object, a line transformer according to the present invention comprises an insulating substrate, a primary coil section provided on one surface of the insulating substrate and a secondary coil section provided on the other surface of the insulating substrate. The primary coil section and the secondary coil section each comprise a first coil pattern layer composed of a plurality of conductors, a second coil pattern layer composed of a plurality of conductors and an insulating layer between the first and the second coil pattern layers, and the conductors of the first coil pattern layer and the conductors of the second coil pattern layer are electrically connected alternately via a hole made in the insulating layer.

Since the primary coil section and the secondary coil section each have a laminate structure of the coil pattern layers and the insulating layers, the line transformer can be made thin and compact compared with the conventional type which has a core wound with a thick primary coil and a thick secondary coil.

A primary coil and a secondary coil are each formed by electrically connecting the conductors of the first coil pattern layer and the conductors of the second coil patter layer alternately via the hole made in the insulating layer. In the structure, even while a current is flowing in these coils, a potential difference between the first coil pattern layer and the second coil pattern layer is very small, whereby only a small stray capacity occurs.

BRIEF DESCRIPTION OF THE DRAWINGS

This and other objects and features of the present invention will be apparent from the following description with reference to the accompanying drawings in which.

DETAILED DESCRIPTION OF THE PREFERRED EMBODIMENTS

An exemplary line transformer according to the present invention is hereinafter described with reference to the accompanying drawings.

Figure 1:
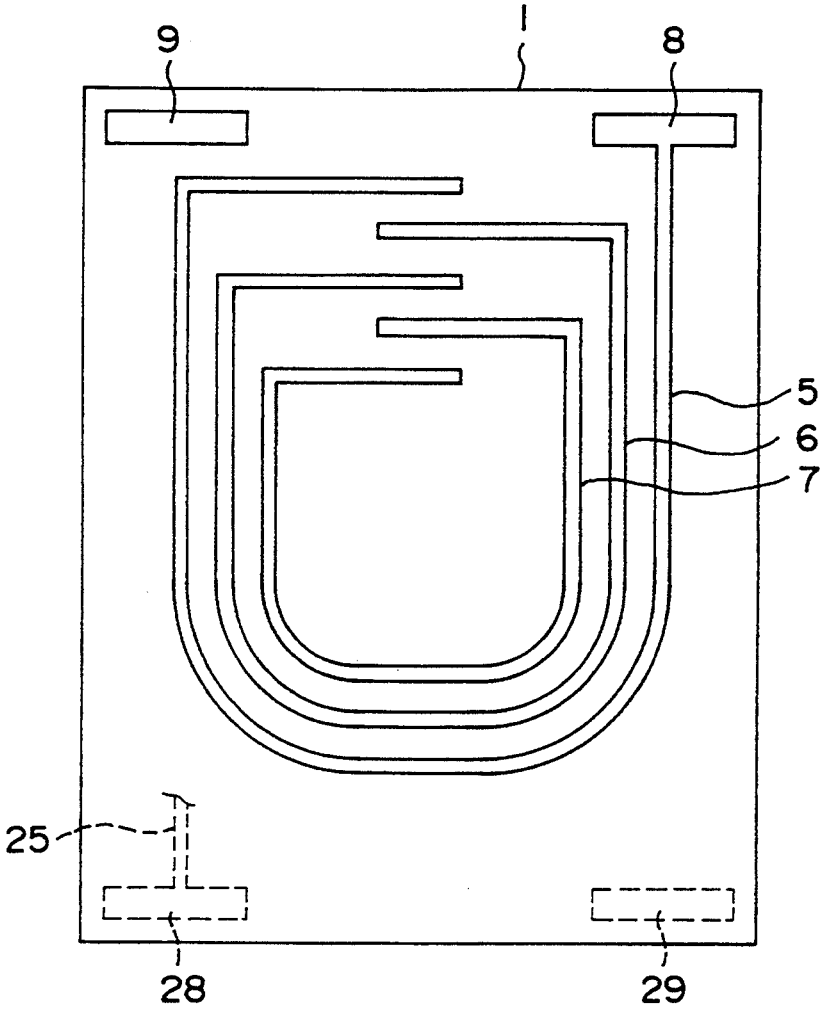
FIG. 1 is a plan view of a line transformer according to the present invention showing a first step of a manufacturing process thereof.

Conductive layers made of copper, silver, silver palladium or the like are provided on the front and the back sides of an insulating substrate 1 entirely by a thin film forming method such as spattering or vapor deposition. Thereafter, resist films are formed on the conductive layers at desired places by photolithography. Next, the conductive layers are removed by etching. However, the parts protected by the resist films are left on the substrate 1. Then, the resist films are removed. In this way, on the front side of the substrate 1, as shown in FIG. 1, separate first primary coil conductors 5, 6 and 7 which will be part of a primary coil, a primary input electrode 8 connected with the coil conductor 5 and a primary output electrode 9 are formed. On the back side of the substrate 1, separate first secondary coil conductors 25, 26 and 27 (see FIG. 5) which will be part of a secondary coil, a secondary input electrode 28 connected with the coil conductor 25 and a secondary output electrode 29 are formed. The coil conductors 25, 26 and 27 have the same shapes as those of the coil conductors 5, 6 and 7 respectively.

Figure 2:
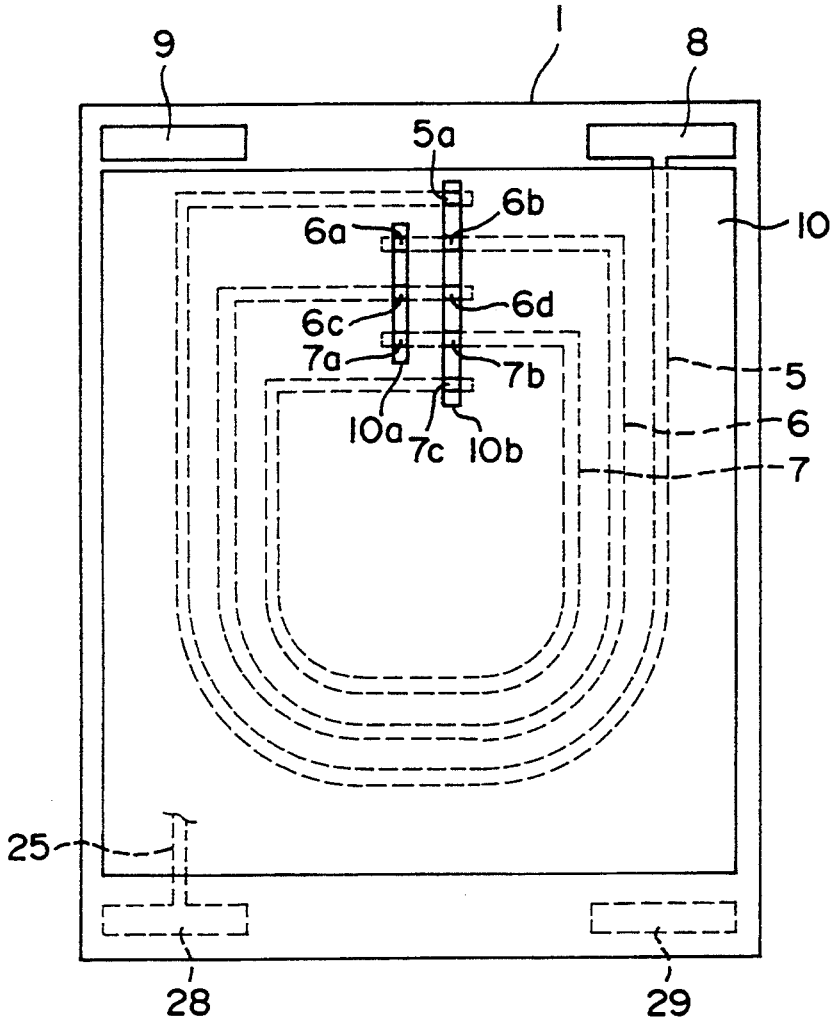
FIG. 2 is a plan view of the line transformer showing a second step of the manufacturing process thereof.

Next, as shown in FIG. 2, an insulating resin made of polyimide or polyamide is coated on the front side of the substrate 1 other than small square parts 10*a* and 10*b* by printing or the like. Then, the resin is dried and hardened to be an insulating film 10. The small square parts 10*a* and 10*b* become holes which act as connecting means to electrically connect the first primary coil conductors 5, 6 and 7 and second primary coil conductors 12, 13 and 14, which will be described later. The coil conductors 5, 6 and 7 protrude their edges 5*a*, 6*a*, 6*b*, 6*c*, 6*d*, 7*a*, 7*b* and 7*c* from the holes 10*a* and 10*b*.

Likewise, the insulating resin made of polyimide or polyamide is coated on the back side of the substrate 1 other than small square parts by printing or the like, and the resin is dried and hardened to be an insulating film 30. The small square parts become holes which act as connecting means to electrically connect the first secondary coil conductors 25, 26 and 27 with second secondary coil conductors 32, 33 and 34, which will be described later. The secondary coil conductors 25, 26 and 27 protrude their edges from the holes.

Figure 3:
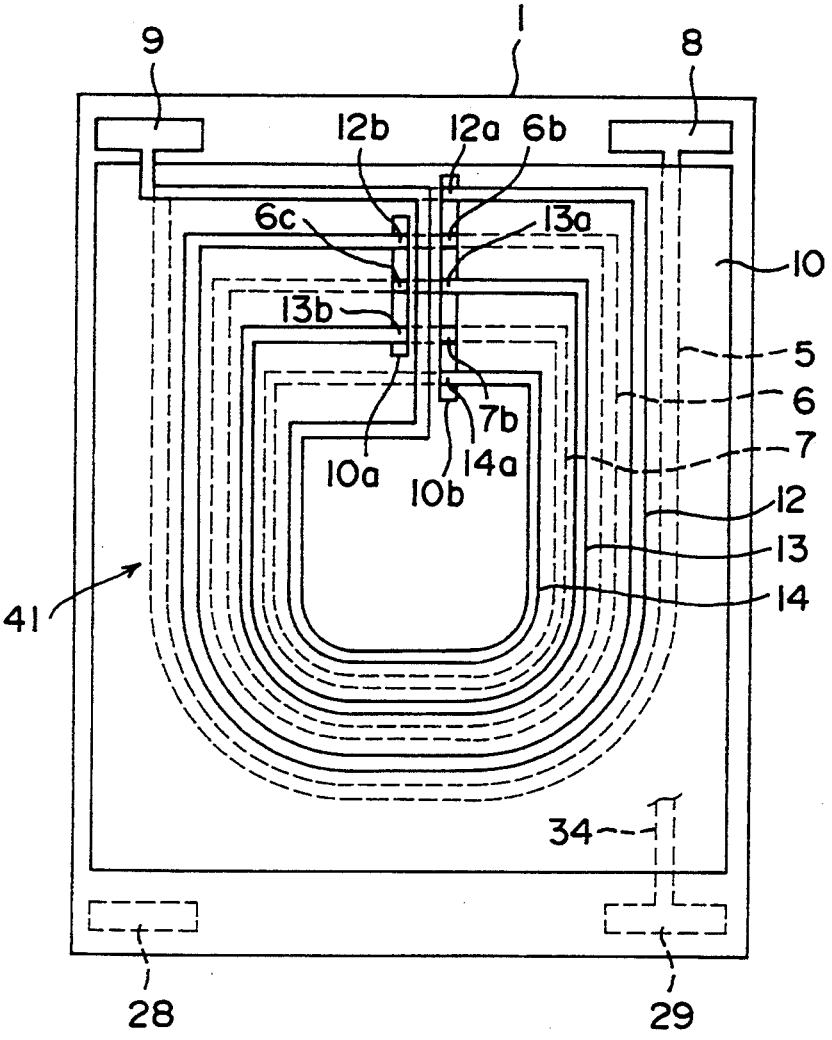
FIG. 3 is a plan view of the line transformer showing a third step of the manufacturing process thereof.

Next, conductive layers made of copper, silver, silver palladium or the like are provided on the front and the back sides of the substrate 1 entirely by a thin film forming method such as spattering or vapor deposition. Thereafter, in the same manner of forming the first primary coil conductors 5, 6 and 7 and the first secondary coil conductors 25, 26 and 27, as shown in FIG. 3, the second primary coil conductors 12, 13 and 14 and the second secondary coil conductors 32, 33 and 34 (see FIG. 5) are formed. The second primary coil conductors 12, 13 and 14 and the second secondary coil conductors 32, 33 and 34 are formed not to be laid upon the first primary coil conductors 5, 6 and 7 and the first secondary coil conductors 25, 26 and 27 respectively. This is to suppress stray capacities of the primary coil and of the secondary coil. The second secondary coil conductors 32, 33 and 34 have the same shapes as those of the second primary coil conductors 12, 13 and 14 respectively. Further, before the etching process, resist films are provided on the edges 6*b*, 6*c* and 7*b* of the first primary coil conductors, the primary input electrode 8 and the primary output electrode 9 so that the edges 6*b*, 6*c* and 7*c* and the electrodes 8 and 9 will be protected from etchant. Likewise. resist films are provided on the edges of the first secondary coil conductors 26 and 27, the secondary input electrode 28 and the secondary output electrode 29 for the same purpose.

The edge 5*a* of the coil conductor 5 is connected with the edge 12*a* of the coil conductor 12 via the hole 10*b*. The edges 6*a* and 6*b* of the coil conductor 6 are connected with the edge 12*b* of the coil conductor 12 and with the edge 13*a* of the coil conductor 13 via the holes 10*a* and 10*b* respectively. The edges 7*a* and 7*c* of the coil conductor 7 are connected with the edge 13*b* of the coil conductor 13 via the hole 10*a* and with the edge 14*a* of the coil conductor 14 via the hole 10*b* respectively. Thus, the primary coil conductors 5, 12, 6, 13, 7 and 14 are serially connected, and a primary coil 41 is formed on the front side of the substrate 1 between the electrodes 8 and 9. In the same manner, the secondary coil conductors 25, 32, 26, 33, 27 and 34 are serially connected, and a secondary coil 42 is formed on the back side of the substrate 1 between the electrodes 28 and 29.

Figure 4:
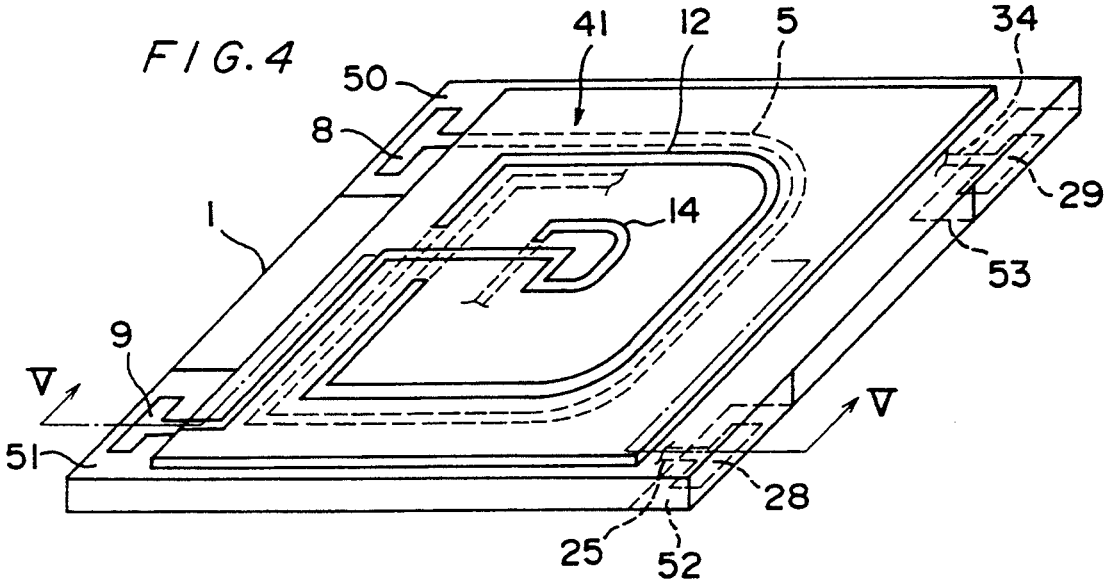
FIG. 4 is a perspective view of the line transformer in the state of FIG. 3.
Figure 5:
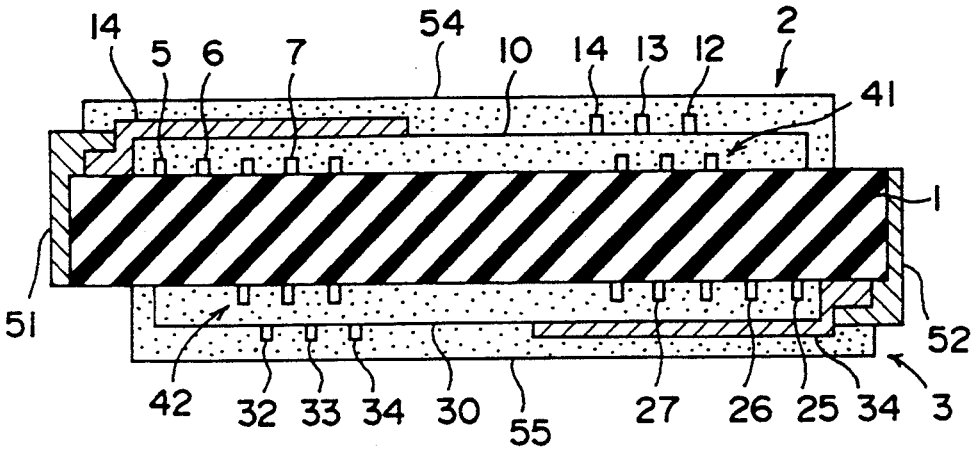
FIG. 5 is a sectional view of the line transformer, taken along a line V—V indicated in FIG. 4.

Next, as shown in FIGS. 4 and 5, fitting electrodes 50, 51, 52 and 53 are provided at the corners of the substrate 1 to extend the electrode 8, 9, 28 and 29. Thereafter, protection films 54 and 55 are coated on the front and the back side of the substrate 1 respectively.

In this way, a line transformer is produced. The line transformer has, on the front side of the substrate 1, a primary coil section 2 composed of the coil conductors 5, 6, 7, 12, 13 and 14, the insulating film 10 and the protection film 54 and on the back side on the substrate 1, a secondary coil section 3 composed of the coil conductors 25, 26, 27, 32, 33 and 34, the insulating film 30 and the protection film 55. Because of the laminate structure, the line transformer is compact and thin compared with a conventional line transformer which has a core wound with a thick primary coil and a thick secondary coil.

Even while a current is flowing in the primary coil 41 and the secondary coil 42, the potential difference between the coil conductors 5 through 7 and the coil conductors 12 through 14 with the protection film 10 in-between and the potential difference between the coil conductors 25 through 27 and the coil conductors 32 through 34 with the protection film 30 in-between are very small, whereby only small stray capacities occur in the primary coil 41 and the secondary coil 42. Accordingly, the line transformer does not degrade its frequency characteristic due to the stray capacities even in a high frequency area. This is described in more detail providing specific examples. A line transformer with coils spiraling eight times is produced in the above-described method. The transformer has an inductance of 92.38 mH and a stray capacity of 0.30 pF. Further, the width of the coil conductors is in a range from 53 μm to 55 μm. For comparison, another laminate type line transformer is produced. This transformer has a first coil pattern layer and a second coil pattern layer each of which is formed of a single conductor, and the first coil pattern and the second coil pattern are serially connected. This transformer has the same inductance as the above transformer and a capacity of 0.70 pF. As is evident from this comparison, a laminate type line transformer according to the present invention can be used in double the range of a frequency area in which a laminate type line transformer whose coil pattern layers are each made of a single conductor can be used.

Although the present invention has been described in connection with the preferred embodiment above, it is to be noted that various changes and modifications are possible to those who are skilled in the art. Such changes and modifications are to be understood as being within the scope of the invention.

In the above embodiment, each of the primary coil and the secondary coil has two coil pattern layers. However, it is possible to compose the primary coil and the secondary coil of three or more coil pattern layers so as to produce a line transformer with a higher inductance.

What is claimed is:

1. A line transformer comprising:

an insulating substrate having two major surfaces;

a primary coil section provided on one surface of the insulating substrate; and a secondary coil section provided on the other surface of the insulating substrate;

wherein each of the primary and the secondary coil sections comprises a first coil pattern layer having a plurality of conductors, a second coil pattern layer having a plurality of conductors and an insulating layer between the first and the second coil pattern layers, and the conductors of the first coil pattern layer and the conductors of the second coil pattern layer are electrically connected alternately via a hole made in the insulating layer.

2. A line transformer as claimed in claim 1, wherein the conductors of the first and the second coil pattern layers of the primary coil section and the secondary coil section are made of copper.

3. A line transformer as claimed in claim 1, wherein the conductors of the first and the second coil pattern layers of the primary coil section and the secondary coil section are made of silver.

4. A line transformer as claimed in claim 1, wherein the conductors of the first and the second coil pattern layers of the primary coil section and the secondary coil section are made of silver palladium.

5. A line transformer as claimed in claim 1, wherein the insulating layers of the primary coil section and the secondary coil section are made of polyimide resin.

6. A line transformer as claimed in claim 1, wherein the insulating layers of the primary coil section and the secondary coil section are made of polyamide resin.

7. A method of producing a line transformer, comprising the steps of:

forming a plurality of conductors which form a first coil pattern layer of a primary coil section on a first surface of an insulating substrate and a plurality of conductors which form a first coil pattern layer of a secondary coil section on a second surface of the insulating substrate;

forming an insulating layer of the primary coil section on the first surface of the substrate such that the insulating layer will have a hole at a specified place and an insulating layer of the secondary coil section on the second surface of the substrate such that the insulating layer will have a hole at a specified place;

forming a plurality of conductors which form a second coil pattern layer of the primary coil section on the first surface of the insulating substrate and a plurality of conductors which form a second coil pattern layer of the secondary coil section on the second surface of the insulating substrate; and electrically connecting, in each of the primary coil section and the secondary coil section, the conductors of the first coil pattern layer with the conductors of the second coil pattern layer alternately via the hole made in the insulating layer to form a coil.

8. A method of producing a line transformer as claimed in claim 7, wherein the insulating layers are formed by printing.

9. A method of producing a line transformer as claimed in claim 7, wherein, both in the primary coil section and the secondary coil section, the conductors of the first and the second coil pattern layers are formed by spattering.

10. A method of producing a line transformer as claimed in claim 7, wherein, both in the primary coil section and the secondary coil section, the conductors of the first and the second coil pattern layers are formed by vapor deposition.

* * * * *